US006539901B2

(12) United States Patent
Nishida et al.

(10) Patent No.: US 6,539,901 B2
(45) Date of Patent: Apr. 1, 2003

(54) INTERNAL COMBUSTION ENGINE HAVING AN ELECTROMAGNETIC VALVE DRIVE MECHANISM AND METHOD FOR CONTROLLING THE SAME

(75) Inventors: Hideyuki Nishida, Susono (JP); Isao Matsumoto, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 46 days.

(21) Appl. No.: 09/822,421

(22) Filed: Apr. 2, 2001

(65) Prior Publication Data

US 2001/0032604 A1 Oct. 25, 2001

(30) Foreign Application Priority Data

Apr. 10, 2000 (JP) ..... 2000-108201

(51) Int. Cl.[7] ..... F01L 9/04
(52) U.S. Cl. ..... 123/90.11; 123/90.15
(58) Field of Search ..... 123/90.11, 90.15; 251/129.1, 129.15, 129.16

(56) References Cited

U.S. PATENT DOCUMENTS 5,070,826 A * 12/1991 Kawamura ..... 123/90.11
5,161,494 A * 11/1992 Brown ..... 123/90.11
5,611,303 A * 3/1997 Izuo ..... 123/90.11
5,669,341 A * 9/1997 Ushirono ..... 123/90.11

FOREIGN PATENT DOCUMENTS

JP A 10-131726 5/1998
JP A 11-280432 10/1999

* cited by examiner

*Primary Examiner*—Thomas Denion
*Assistant Examiner*—Jaime Corrigan
(74) *Attorney, Agent, or Firm*—Oliff & Berridge, PLC

(57) ABSTRACT

An internal combustion engine and method are capable of reducing a power consumption required to open an exhaust-side electromagnetic valve at a predetermined time. This internal combustion engine includes an electromagnetic valve drive mechanism that controls an exhaust valve of the internal combustion engine to open and close by using electromagnetic force generated in response to application of a magnetizing current, and a controller that controls the electromagnetic valve drive mechanism. The controller changes, under predetermined conditions, an open timing of the exhaust valve so as to reduce the power consumption of the electromagnetic valve drive mechanism.

24 Claims, 6 Drawing Sheets

INTERNAL COMBUSTION ENGINE HAVING AN ELECTROMAGNETIC VALVE DRIVE MECHANISM AND METHOD FOR CONTROLLING THE SAME

INCORPORATION BY REFERENCE

The disclosure of Japanese Patent Application No. 2000-108201 filed on Apr. 10, 2000 including the specification, drawings and abstract is incorporated herein by reference in its entirety.

BACKGROUND OF THE INVENTION

1. Field of Invention

The invention relates to an internal combustion engine provided with an electromagnetic valve drive mechanism for causing an exhaust valve to open and close by using electromagnetic force, and a method for controlling the same.

2. Description of Related Art

In recent years, in an internal combustion engine mounted in an automobile or the like, an electromagnetic valve drive mechanism that is capable of arbitrarily controlling the open and close timing of intake and exhaust valves has been developed for the purpose of preventing mechanical loss, due to opening and closing of the intake and exhaust valves while reducing intake pumping loss, and improving net thermal efficiency.

For example, an electromagnetic valve drive mechanism that has an armature, valve-closing electromagnet, valve-opening electromagnet, valve-closing return spring, valve-opening return spring has been proposed. The armature is formed from a magnetic body, and operates to advance and retract in conjunction with the intake and exhaust valves. The valve-closing electromagnet generates an electromagnetic force, in response to a magnetizing current, that displaces the armature in the valve-closing direction. Moreover, the valve-opening electromagnet generates an electromagnetic force, in response to a magnetizing current, that displaces the armature to the valve-opening direction. Finally, the valve-closing return spring retracts the armature to the valve-closing direction, while the valve-opening return spring projects the armature to the valve-opening direction.

Such an electromagnetic valve drive mechanism eliminates the need to mechanically control intake and exhaust valves to open and close using the rotation force of an engine output shaft, i.e., crankshaft, as in a conventional valve train. Therefore, mechanical loss due to mechanically driving the intake and exhaust valves is prevented.

Moreover, the aforementioned electromagnetic valve drive mechanism can independently control the intake and exhaust valves to open and close without the rotation of the engine output shaft. This configuration is advantageous in various respects, such as an increased ability to control the open and close timing, as well as the amount the intake and exhaust valves open.

On the other hand, a vehicle provided with an internal combustion engine having the electromagnetic valve drive mechanism can also include various other electrical equipment, such as spark plugs, fuel injection valves, air-conditioner and headlights. This electrical equipment is powered by the battery and generator that are mounted in the vehicle.

In order to avoid increasing the capacity of the battery and generator, an electromagnetic valve drive circuit, as described in Japanese Patent Laid-Open Publication No. HIE 10-131726, has been proposed. The electromagnetic valve drive circuit described in this publication has a permanent magnet, drive coil, switching portion, and condenser. The permanent magnet is integrally attached to the intake and exhaust valves, and the drive coil generates a magnetic pole that displaces the permanent magnet. The switching portion switches the direction of a magnetizing current applied to the drive coil, and also acts to start and discontinue supply of the magnetizing current to the drive coil. The condenser stores electromotive force induced in the drive coil by inertial movement of the permanent magnet.

This electromagnetic valve drive circuit uses both the electromotive force induced in the drive coil, and the inductance of the drive coil to cause the switching portion to act as a booster switching regulator. This function increases the amount of power regeneratively charged in the condenser. As a result, the amount of power that can be supplied from the condenser to the drive coil is also increased. Accordingly, the amount of power supplied from the outside to the electromagnetic valve drive circuit, i.e., power consumption of the electromagnetic drive circuit, is reduced.

In the aforementioned technology, the power regeneratively charged in the condenser is extremely small as compared to the driving power of the electromagnetic valve drive mechanism. Therefore, when the power required to drive the electromagnetic valve drive mechanism is increased, e.g., when the operating state of the internal combustion engine is operating in a high revolution region, or depending on the operating state of the electrical equipment, other than the electromagnetic valve drive mechanism, it may be impossible to supply the desired driving power to the electromagnetic valve drive mechanism even by using the power of the condenser in addition to the power of both the battery and generator. In such a case, it may be difficult to control the intake and exhaust valves to open and close normally.

For example, when the operating state of the internal combustion engine is operating in the high revolution region, the number of times the intake and exhaust valves open and close per unit time is increased. Therefore, the power required to drive the electromagnetic valve drive mechanism is increased in demand. In addition, the number of times the spark plug and fuel injection valve are actuated per unit time is also increased, along with an increase in the power consumption of the spark plug and fuel injection valve. As a result, the amount of power that can be supplied to the electromagnetic valve drive mechanism is reduced.

In particular, if the electric equipment such as air-conditioner and headlight are operating while the operating state of the internal combustion engine is operating in the high revolution region, the amount of power that can be supplied to the electromagnetic valve drive mechanism is further reduced. Therefore, it may be more difficult to ensure that the required power of the electromagnetic valve drive mechanism is provided.

Moreover, the electromagnetic valve drive mechanism is connected through wire harness to the battery, generator and the like. Therefore, when the operating state of the internal combustion engine is operating in the high revolution region, the amount of current flowing through the wire harness per unit time may increase and exceed a capacity of the wire harness. In this example, it is difficult to supply a desired amount of current to the electromagnetic valve drive mechanism, which can cause the intake and exhaust valves to not open and close normally.

To solve this problem, it is possible to increase the cross-sectional area of the wire harness so as to increase the capacity of current per unit time of the wire harness. However, if the cross-sectional area of the wire harness is excessively increased, the space occupied by the electromagnetic valve drive mechanism, including the wire harness, is subsequently increased, which can make it difficult to mount the electromagnetic valve drive mechanism to the vehicle.

SUMMARY OF THE INVENTION

It is an object of the invention to improve reliability of the open/close operation of an exhaust valve by an electromagnetic valve drive mechanism, by providing technology capable of reducing the power required to drive the electromagnetic valve drive mechanism in an internal combustion engine having an electromagnetic valve.

An internal combustion engine having an electromagnetic valve of the invention is provided with a controller for changing an open timing of an exhaust valve so as to reduce power consumption of an electromagnetic valve drive mechanism at a predetermined time. The electromagnetic valve drive mechanism controls the exhaust valve of the internal combustion engine to open and close by using electromagnetic force generated in response to application of a magnetizing current.

Accordingly, in an internal combustion engine having the electromagnetic valve, the controller changes, under predetermined conditions, the open timing of the exhaust valve so as to reduce power consumption of the electromagnetic valve drive mechanism.

In this case, power consumption of the electromagnetic valve drive mechanism under the predetermined conditions is reduced. In other words, the electromagnetic valve drive mechanism controls the exhaust valve to open and close with relatively small power consumption.

As a result, reliability of the open and close operation of the exhaust valve is improved even when the amount of power that can be supplied to the electromagnetic valve train is reduced.

DETAILED DESCRIPTION OF PREFERRED EMBODIMENTS

Hereinafter, specific embodiments of an internal combustion engine having an electromagnetic valve according to this invention will be described.

Figure 1:
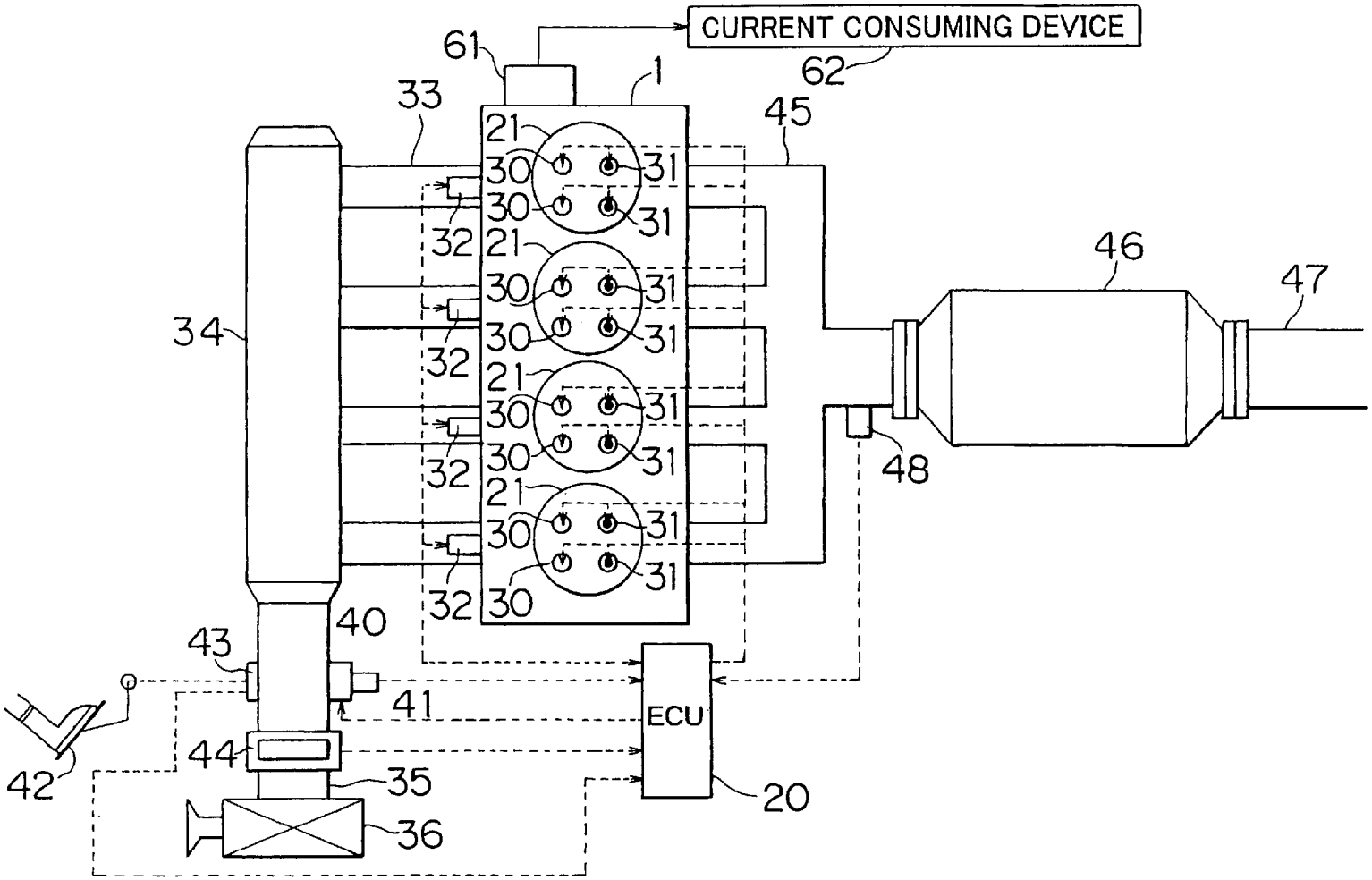
FIG. 1 is a schematic plan view showing an internal combustion engine having an electromagnetic valve according to an embodiment of this invention.
Figure 2:
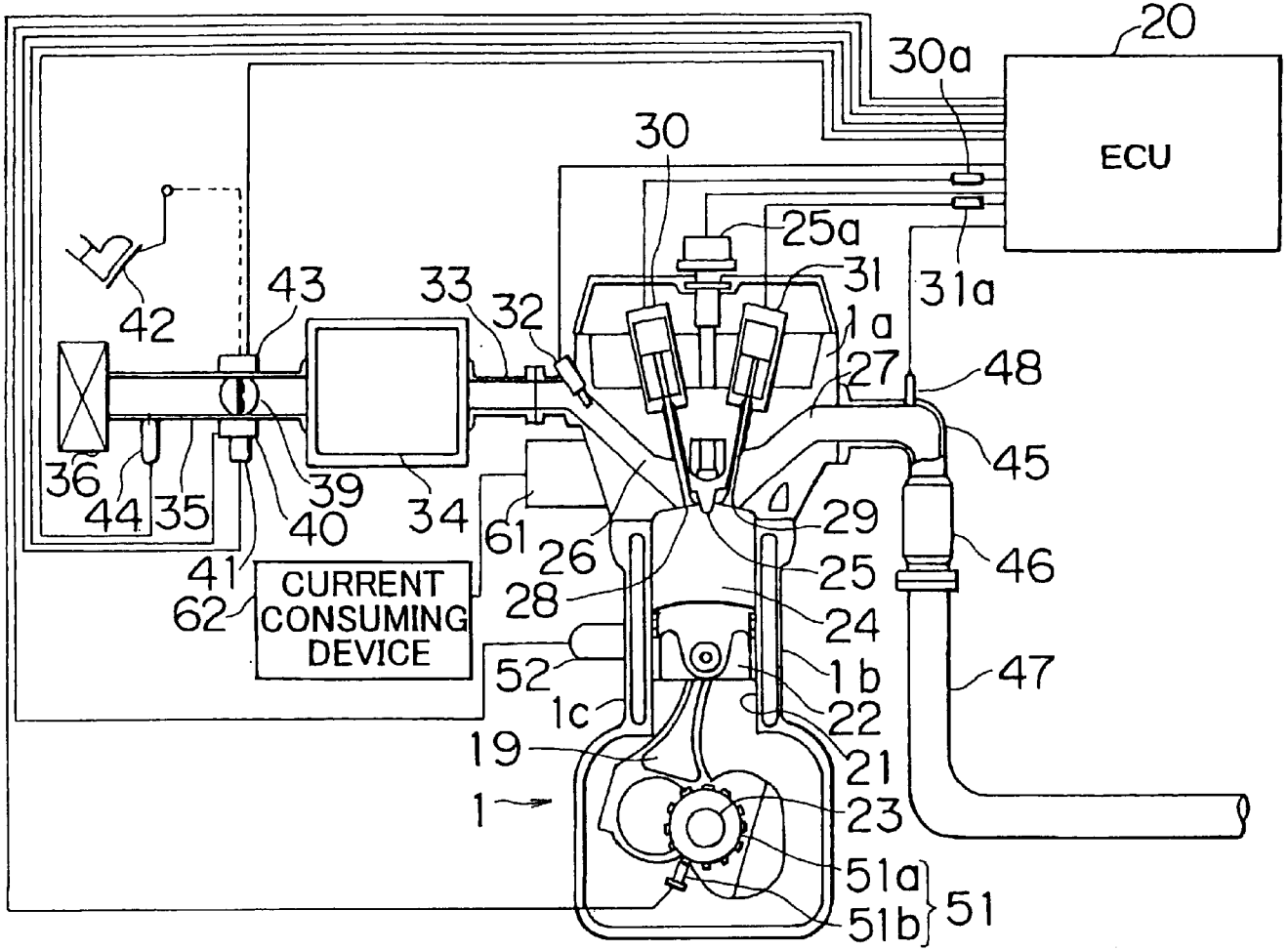
FIG. 2 is a schematic diagram showing the internal structure of an internal combustion engine according to an embodiment of this invention.

FIGS. 1 and 2 are diagrams showing the schematic structure of an internal combustion engine and its intake and exhaust system according to this embodiment. The internal combustion engine 1 shown in FIGS. 1 and 2 is a water-cooled four-stroke cycle gasoline engine provided with four cylinders 21.

The internal combustion engine 1 is provided with a cylinder block 1*b* and a cylinder head 1*a*. The four cylinders 21 and a cooling water passage 1*c* are formed in the cylinder block 1*b*. The cylinder head 1*a* is fixed to the top of the cylinder block 1*b*.

A crankshaft 23 serving as an engine output shaft is rotatably supported by the cylinder block 1*b*. This crankshaft 23 is coupled to pistons 22 through respective connecting rods 19. The pistons 22 are slidably loaded within the respective cylinders 21.

A combustion chamber 24 is defined above the piston 22 of each cylinder 21 by the top surface of the corresponding piston 22 and the wall surface of the cylinder head 1*a*. Spark plugs 25 are mounted to the cylinder head 1*a* so as to face the combustion chambers 24 of the respective cylinders 21. An ignitor 25*a* for applying a driving current to the spark plugs 25 is connected to the spark plugs 25.

Two open ends of intake ports 26 and two open ends of exhaust ports 27 are formed in the cylinder head 1*a* at positions facing the combustion chamber 24 of each cylinder 21. Intake valves 28 for opening and closing the respective open ends of the intake ports 26 and exhaust valves 29 for opening and closing the respective open ends of the exhaust ports 27 are provided in the cylinder head 1*a* so as to be able to advance and retract.

The cylinder head 1*a* is provided with the same number of electromagnetic drive mechanisms as that of intake valves 28 (hereinafter referred to as intake-side electromagnetic drive mechanisms 30). The intake-side electromagnetic drive mechanisms 30 advance and retract the respective intake valves 28 with the electromagnetic force generated in response to application of a magnetizing current. A drive circuit (hereinafter referred to as intake-side drive circuit 30*a*) is electrically connected to each intake-side electromagnetic drive mechanism 30. The intake-side drive circuit 30*a* serves to apply the magnetizing current to the intake-side electromagnetic drive mechanisms 30.

The cylinder head 1*a* is provided with a corresponding number of electromagnetic drive mechanisms as exhaust valves 29 (hereinafter referred to as exhaust-side electromagnetic drive mechanisms 31). The exhaust-side electromagnetic drive mechanisms 31 advance and retract the respective exhaust valves 29 with the electromagnetic force generated in response to application of a magnetizing current. A drive circuit (hereinafter referred to as exhaust-side drive circuit 31*a*) is electrically connected to each exhaust-side electromagnetic drive mechanism 31. The exhaust-side drive circuit 31*a* serves to apply the magnetizing current to the exhaust-side electromagnetic drive mechanisms 31.

Hereinafter, the specific structure of the intake-side electromagnetic drive mechanism 30 and exhaust-side electromagnetic drive mechanism 31 will be described. Note that, since the intake-side electromagnetic drive mechanism 30 and the exhaust-side electromagnetic drive mechanism 31 have the same structure, only the intake-side electromagnetic drive mechanism 30 will be described.

Figure 3:
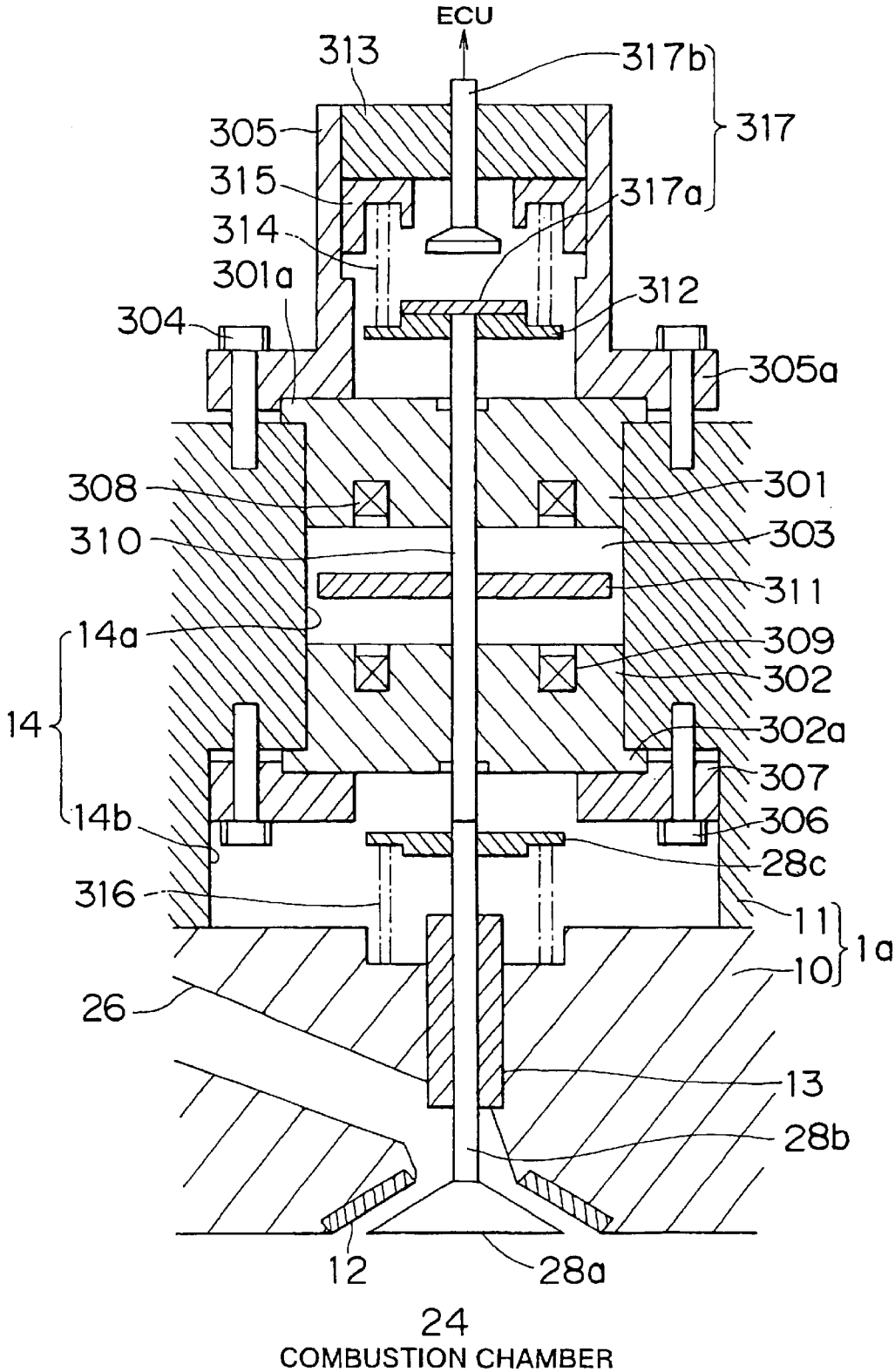
FIG. 3 is a diagram showing the internal structure of an intake-side electromagnetic drive mechanism.

FIG. 3 is a cross-sectional view showing the structure of the intake-side electromagnetic drive mechanism 30. In FIG. 3, the cylinder head 1*a* of the internal combustion engine 1 is provided with a lower head 10 and an upper head 11. The lower head 10 is fixed to the top surface of the cylinder block 1*b*. The upper head 11 is provided on top of the lower head 10.

Two intake ports 26 per cylinder 21 are formed in the lower head 10, and a valve seat 12 for seating a valve body 28*a* of the intake valve 28 thereon is provided at the open end of each intake port 26 that faces the combustion chamber 24.

A through hole having a circular cross section is formed in the lower head 10 so as to extend from the inner wall surface of each intake port 26 to the top surface of the lower head 10. A cylindrical valve guide 13 is inserted into each through hole. A valve shaft 28*b* of the intake valve 28 extends through the inner hole of the valve guide 13 so as to be able to advance and retract in the axial direction.

A core attachment hole 14 having a circular cross section is formed in the upper head 11 so as to have the same central axis as that of the valve guide 13. First and second cores 301 and 302 are fitted in the core attachment hole 14. The lower portion of the core attachment hole 14 has a diameter larger than that of the upper portion thereof. Hereinafter, the lower portion of the core attachment hole 14 is referred to as large diameter portion 14*b*, and the upper portion of the core attachment hole 14 is referred to as small diameter portion 14*a*.

The first and second cores 301 and 302 are axially fitted in series in the small diameter portion 14*a* with a predetermined gap 303 therebetween. The first and second cores 301 and 302 are each formed from an annular soft magnetic body. A flange 301*a* is formed at the upper end of the first core 301. The first core 301 is fitted into the core attachment hole 14 from above. The first core 301 is positioned by the flange 301*a* abutting on a corresponding edge portion of the core attachment hole 14. A flange 302*a* is formed at the lower end of the second core 302. The second core 302 is fitted into the core attachment hole 14 from beneath. The second core 302 is positioned by the flange 302*a* abutting on a corresponding edge portion of the core attachment hole 14. Thus, the predetermined gap 303 is retained between the first and second cores 301 and 302.

A cylindrical upper cap 305 is provided on the first core 301. This upper cap 305 is fixed to the top surface of the upper head 11 by means of bolts 304 extending through a flange portion 305*a* formed at the lower end of the upper cap 305. In this case, the lower end of the upper cap 305 including the flange portion 305*a* is fixed to the peripheral edge portion of the top surface of the first core 301 in an abutting manner. As a result, the first core 301 is fixed to the upper head 11.

On the other hand, a lower cap 307 formed from an annular body having an outer diameter substantially the same as the diameter of the large diameter portion 14*b* of the core attachment hole 14 is provided under the second core 302. Bolts 306 extend through the lower cap 307. With these bolts 306, the lower cap 307 is fixed to the downward-facing surface of the stepped portion between the small diameter portion 14*a* and large diameter portion 14*b*. In this case, the lower cap 307 is fixed to the peripheral edge portion of the lower surface of the second core 302 in an abutting manner. As a result, the second core 302 is fixed to the upper head 11.

A first electromagnetic coil 308 is held in a groove formed at the surface of the first core 301 facing the gap 303. A second electromagnetic coil 309 is held in a groove formed at the surface of the second core 302 facing the gap 303. The first and second electromagnetic coils 308 and 309 are located so as to face each other with the gap 303 therebetween. The first and second electromagnetic coils 308 and 309 are electrically connected to the aforementioned intake side drive circuit 30*a*.

An armature 311 is provided in the gap 303. The armature 311 is an annular soft magnetic body having an outer diameter smaller than the inner diameter of the gap 303. An armature shaft 310 vertically extending along the central axis of the armature 311 is fixed in a hollow portion of the armature 311. This armature shaft 310 extends through a hollow portion of the first core 301 such that the upper end of the armature shaft 310 is located inside the upper cap 305. The armature shaft 310 also extends through a hollow portion of the second core 302 such that the lower end of the armature shaft 310 is located inside the large diameter portion 14*b*. Thus, the armature shaft 310 is held by the first and second cores 301 and 302 so as to be able to advance and retract in the axial direction.

A disk-shaped upper retainer 312 is bonded to the upper end portion of the armature shaft 310 extending into the upper cap 305. An adjusting bolt 313 is screwed into an upper opening of the upper cap 305. An upper spring 314 is interposed between the upper retainer 312 and adjusting bolt 313. A spring sheet 315 having an outer diameter substantially the same as the inner diameter of the upper cap 305 is interposed between the abutting surfaces of the adjusting bolt 313 and upper spring 314.

On the other hand, the upper end of the valve shaft 28*b* of the intake valve 28 abuts on the lower end of the armature shaft 310 extending into the large diameter portion 14*b*. A disk-shaped lower retainer 28*c* is bonded to the outer periphery of the upper end portion of the valve shaft 28*b*. A lower spring 316 is interposed between the lower surface of the lower retainer 28*c* and the upper surface of the lower head 10.

In the intake-side electromagnetic drive mechanism 30 structured as such, when no magnetizing current is being applied from the intake-side drive circuit 30*a* to the first and second electromagnetic coils 308 and 309, a downward biasing force, i.e., in the direction to open the intake valve 28, is applied from the upper spring 314 to the armature shaft 310, as well as upward biasing force, i.e., in the direction to close the intake valve 28, is applied from the lower spring 316 to the intake valve 28. As a result, the armature shaft 310 and intake valve 28 abut on each other, and thus are held at predetermined positions in an elastically supported state, i.e., in a neutral state.

Note that the respective biasing forces of the upper spring 314 and lower spring 316 are set such that the neutral position of the armature 311 corresponds to the intermediate position in the gap 303 between the first and second cores 301 and 302. If the neutral position of the armature 311 is displaced from the aforementioned intermediate position due to initial tolerance, aging, etc. of the components, the neutral position of the armature 311 can be adjusted to the intermediate position by using the adjusting bolt 313.

The respective axial lengths of the armature shaft 310 and valve shaft 28*b* are set such that the valve body 28*a* is held in the intermediate position between the fully open displacement end and the fully closed displacement end (hereinafter referred to as mid-open position) when the armature 311 is located at the intermediate position of the gap 303.

In the intake-side electromagnetic drive mechanism 30, if a magnetizing current is applied from the intake-side drive circuit 30*a* to the first electromagnetic coil 308, an electromagnetic force is generated between the first core 301, i.e., the first electromagnetic coil 308, and armature 311 so as to displace the armature 311 toward the first core 301. The armature 311 retracts due to this electromagnetic force.

With the armature 311 retracting in this fashion, the intake valve 28 is closed by the biasing force of the lower spring 316.

In the intake-side electromagnetic drive mechanism 30, if a magnetizing current is applied from the intake-side drive circuit 30*a* to the second electromagnetic coil 309, an electromagnetic force is generated between the second core 302, i.e., the second electromagnetic coil 309, and armature 311 so as to displace the armature 311 toward the second core 302. The armature 311 advances due to this electromagnetic force.

Thus, the armature 311 advances with the armature shaft 310 abutting on the valve shaft 28*b* of the intake valve 28. As a result, the intake valve 28 is opened against the biasing force of the lower spring 316.

Therefore, in the intake-side electromagnetic drive mechanism 30, the armature 311 advances and retracts by the magnetizing current applied from the intake-side drive circuit 30*a* alternately to the first and second electromagnetic coils 308 and 309. Accordingly, the valve shaft 28*b* is controlled to advance and retract as well as the valve body 28*a* is controlled to open and close.

The opening and closing timing of the intake valve 28 can be arbitrarily controlled by changing the magnitude and application timing of the magnetizing current to the first electromagnetic coil 308 and second electromagnetic coil 309.

A valve lift sensor 317 for detecting displacement of the intake valve 28 is also mounted to the intake-side electromagnetic drive mechanism 30. This valve lift sensor 317 is comprised of a disk-shaped target 317*a* and a gap sensor 317*b*. The disk-shaped target 317*a* is attached to the top surface of the upper retainer 312. The gap sensor 317*b* is mounted in the adjusting bolt 313 so as to face the upper retainer 312.

The target 317*a* is displaced integrally with the armature 311 of the intake-side electromagnetic drive mechanism 30. The gap sensor 317*b* outputs an electric signal corresponding to the distance between the gap sensor 317*b* and target 317*a* to an electronic control unit (ECU) 20 that will be described later.

An output signal value of the gap sensor 317*b* corresponding to the neutral state of the armature 311 is pre-stored in the ECU 20. Thus, displacement of the armature 311 and intake valve 28 can be specified by calculating a deviation of a current output signal value of the gap sensor 317*b* from the pre-stored output signal value.

Referring back to FIGS. 1 and 2, an intake branch pipe 33 formed from four branch pipes is connected to the cylinder head 1*a* of the internal combustion engine 1. Each branch pipe of the intake branch pipe 33 communicates with the intake ports 26 of the respective cylinder 21.

Fuel injection valves 32 are attached to the cylinder head 1*a* near the joint portion with the intake branch pipe 33 such that their nozzles face the inside of the corresponding intake ports 26.

The intake branch pipe 33 is connected to a surge tank 34 for suppressing intake surges. The surge tank 34 is connected to an intake pipe 35. The intake pipe 35 is connected to an air cleaner box 36 for removing dust and impurities from the intake air.

An airflow meter 44 for outputting an electric signal corresponding to the mass of the air flowing through the intake pipe 35, i.e., the mass of the intake air, is mounted to the intake pipe 35. A throttle valve 39 for adjusting the flow rate of the intake air flowing through the intake pipe 35 is provided downstream of the airflow meter 44 within the intake pipe 35.

A throttle actuator 40 and a throttle position sensor 41 are mounted to the throttle valve 39.

The throttle actuator 40 is formed from a stepper motor or the like, and drives the throttle valve 39 to open and close according to the magnitude of the applied power. The throttle position sensor 41 outputs an electric signal corresponding to the opening amount of the throttle valve 39.

An accelerator lever which is not shown is attached to the throttle valve 39. This accelerator lever is capable of pivoting independently of the throttle valve 39, and pivots according to the operation of an accelerator pedal 42. An accelerator position sensor 43 for outputting an electric signal corresponding to the pivot amount of the accelerator lever is mounted to the accelerator lever.

An exhaust branch pipe 45 formed from four branch pipes merged into a single collecting pipe at a position immediately downstream of the internal combustion engine 1 is connected to the cylinder head 1*a* of the internal combustion engine 1. Each branch pipe of the exhaust branch pipe 45 communicates with the exhaust ports 27 of the respective cylinder 21.

The exhaust branch pipe 45 is connected to an exhaust pipe 47 via an exhaust purifying catalyst 46. The downstream end of the exhaust pipe 47 is connected to a muffler which is not shown. An air-fuel ratio sensor 48 is mounted to the exhaust branch pipe 45. The air-fuel ratio sensor 48 outputs an electric signal corresponding to the air-fuel ratio of the exhaust flowing through the exhaust branch pipe 45, i.e., the exhaust flowing into the exhaust purifying catalyst 46.

For example, the exhaust purifying catalyst 46 may be any one of a three-way catalyst, an occlusion reduction type NOx catalyst and a selection reduction type NOx catalyst, or may be an appropriate combination of any of these catalysts.

The three-way catalyst is a catalyst for purifying hydrocarbons (HC), carbon monoxide (CO) and nitrogen oxides (NOx) in the exhaust gas when the exhaust gas flowing into the exhaust purifying catalyst 46 has a predetermined air-fuel ratio close to a theoretical air-fuel ratio. The occlusion reduction type NOx catalyst is a catalyst for occluding nitrogen oxides (NOx) in the exhaust gas when the exhaust gas flowing into the exhaust purifying catalyst 46 has a lean air-fuel ratio, and for reducing and purifying occluded nitrogen oxides (NOx) while discharging them when the exhaust gas flowing into the exhaust purifying catalyst 46 has a theoretical or rich air-fuel ratio. The selection reduction type NOx catalyst is a catalyst for reducing and purifying nitrogen oxides (NOx) in the exhaust gas when the air-fuel ratio of the exhaust gas flowing into the exhaust purifying catalyst 46 is abundant with oxygen and a predetermined reducing agent is present.

An alternator 61 for converting the rotation energy of the crankshaft 23 to electric energy is attached to the internal combustion engine 1. The alternator 61 is also coupled to the crankshaft 23 through a belt which is not shown.

Additional devices that consume current 62, such as in-vehicle air-conditioner, defroster, headlight and wiper is connected to the alternator 61. The power generated by the alternator 61 is supplied to these current consuming devices 62.

The ignitor 25*a*, fuel injection valves 32, intake-side drive circuit 30*a*, and exhaust-side drive circuit 31*a*, are also connected to the alternator 61 through wire harness. The alternator 61 supplies the individual driving power to the ignitor 25*a*, fuel injection valves 32, intake-side drive circuit 30*a*, and exhaust-side drive circuit 31*a*.

The internal combustion engine 1 is provided with a crank position sensor 51 and a water temperature sensor 52. The crank position sensor 51 is composed of a timing rotor 51*a* and an electromagnetic pickup 51*b*. The timing rotor 51*a* is attached to the end portion of the crankshaft 23. The electromagnetic pickup 51*b* is attached to the cylinder block 1*b* in the vicinity of the timing rotor 51*a*. The water temperature sensor 52 is attached to the cylinder block 1*b* in order to detect the temperature of the cooling water flowing through the cooling water passage 1*c* formed within the internal combustion engine 1.

The ECU 20 for controlling the operating state of the internal combustion engine 1 is also provided.

Various sensors such as a throttle position sensor 41, accelerator position sensor 43, airflow meter 44, air-fuel ratio sensor 48, crank position sensor 51, water temperature sensor 52, and valve lift sensors 317 are connected via electrical wiring to the ECU 20. Output signals of these sensors are input to the ECU 20.

The ignitor 25*a*, intake-side drive circuit 30*a*, exhaust-side drive circuit 31*a*, fuel injection valves 32, and throttle actuator 40 are connected via electrical wiring to the ECU 20. The ECU 20 is capable of controlling the ignitor 25*a*, intake-side drive circuit 30*a*, exhaust-side drive circuit 31*a*, fuel injection valves 32, and throttle actuator 40 by using output signal values of the various sensors as parameters.

Figure 4:
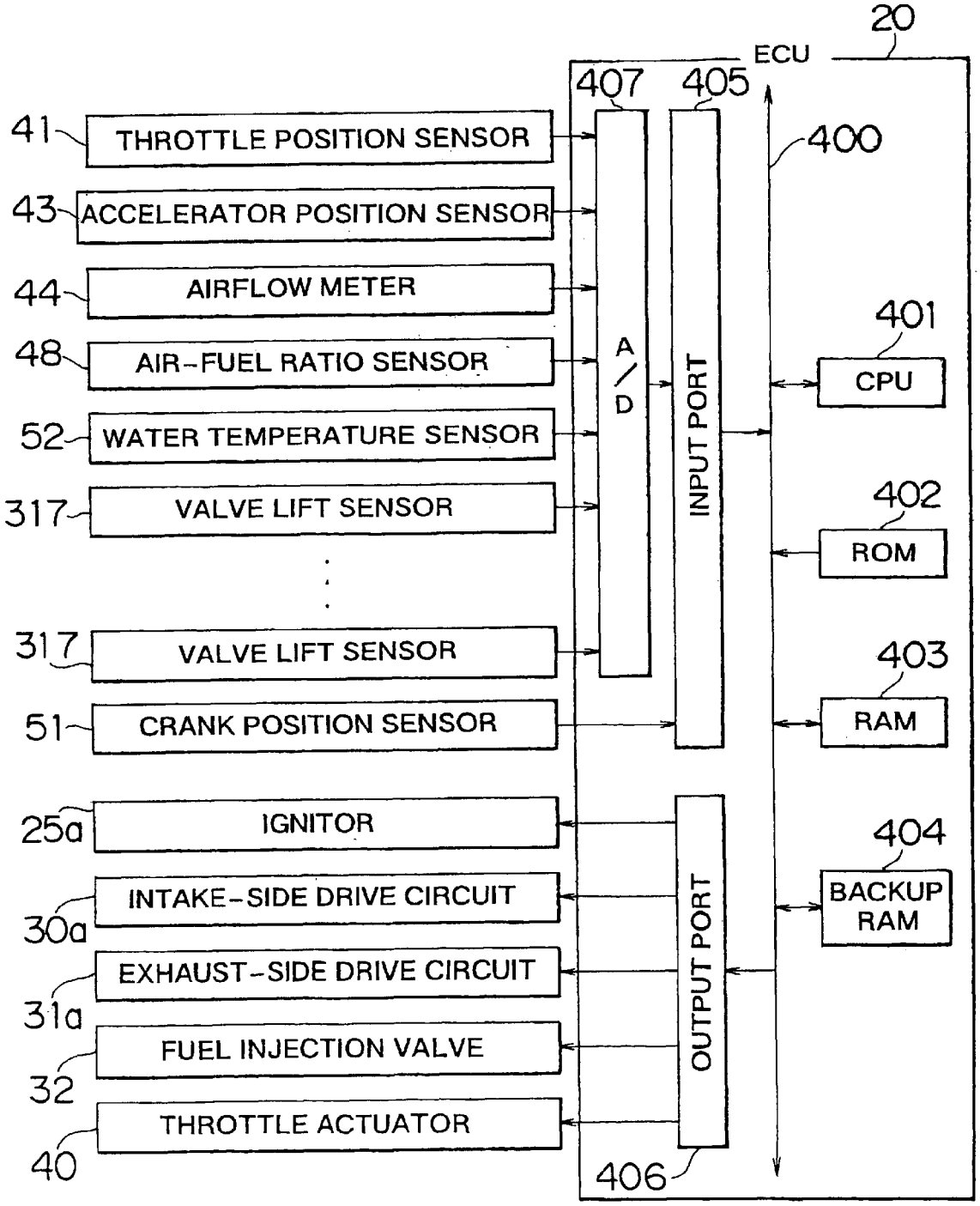
FIG. 4 is a block diagram showing the internal structure of an electronic control unit (ECU) used in an embodiment of this invention.

As shown in FIG. 4, the ECU 20 is provided with a CPU 401, a ROM 402, a RAM 403, a backup RAM 404, an input port 405, an output port 406, and an A/D converter (A/D) 407. The CPU 401, ROM 402, RAM 403, backup RAM 404, input port 405 and output port 406 are connected to each other via a bi-directional bus 400. The A/D converter (A/D) 407 is connected to the input port 405.

The sensors that output signals in an analog signal format, i.e., the throttle position sensor 41, accelerator position sensor 43, airflow meter 44, air-fuel ratio sensor 48, water temperature sensor 52, and valve lift sensors 317, are connected via electrical wiring to the A/D 407. The A/D 407 converts the output signals of the aforementioned sensors from the analog signal format to digital signal format for transmission to the input port 405.

The input port 405 is also connected to sensors that output signals in a digital signal format, such as the crank position sensor 51.

The input port 405 receives the output signals of the various sensors directly or via the A/D 407. The input port 405 then transmits the received output signals of the various sensors to the CPU 401 and RAM 403 over the bi-directional bus 400.

The output port 406 is connected via electrical wiring to the ignitor 25*a*, intake-side drive circuit 30*a*, exhaust-side drive circuit 31*a*, fuel injection valves 32, and throttle actuator 40. The output port 406 receives a control signal from the CPU 401 over the bi-directional bus 400. The output port 406 then transmits the control signal to the ignitor 25*a*, intake-side drive circuit 30*a*, exhaust-side drive circuit 31*a*, fuel injection valves 32, or throttle actuator 40.

The ROM 402 stores a power consumption reduction control routine in addition to application programs such as fuel injection amount control routine, fuel injection timing control routine, intake valve opening/closing timing control routine, exhaust valve opening/closing timing control routine, intake-side magnetizing current amount control routine, exhaust-side magnetizing current amount control routine, ignition timing control routine and throttle opening amount control routine.

The fuel injection amount control routine determines the fuel injection amount. The fuel injection timing control routine decides the fuel injection timing. The intake valve opening/closing timing control routine determines the opening and closing timing of the intake valve 28. The exhaust valve opening/closing timing control routine determines the opening and closing timing of the exhaust valve 29. The intake-side magnetizing current amount control routine determines the amount of magnetizing current to be applied to the intake-side electromagnetic drive mechanism 30. The exhaust-side magnetizing current amount control routine determines the amount of magnetizing current to be applied to the exhaust-side electromagnetic drive mechanism 31. The ignition timing control routine determines the ignition timing of the spark plug 25 of each cylinder 21. The throttle opening amount control routine determines the opening amount of the throttle valve 39. The power consumption reduction control routine reduces the power consumption of the exhaust-side electromagnetic drive mechanism 31 at a predetermined time.

The ROM 402 stores various control maps in addition to the above application programs. Examples of these control maps include a fuel injection amount control map, a fuel injection timing control map, an intake valve opening/closing timing control map, an exhaust valve opening/closing timing control map, an intake-side magnetizing current amount control map, an exhaust-side magnetizing current amount control map, an ignition timing control map, and a throttle opening amount control map.

The fuel injection amount control map shows the relation between the operating state of the internal combustion engine 1 and the fuel injection amount. The fuel injection timing control map shows the relation between the operating state of the internal combustion engine 1 and the fuel injection timing. The intake valve open/close timing control map shows the relation between the operating state of the internal combustion engine 1 and the open and close timing of the intake valve 28. The exhaust valve open/close timing control map shows the relation between the operating state of the internal combustion engine 1 and the open and close timing of the exhaust valve 29. The intake-side magnetizing current amount control map shows the relation between the operating state of the internal combustion engine 1 and the amount of magnetizing current to be applied to the intake-side electromagnetic drive mechanism 30. The exhaust-side magnetizing current amount control map shows the relation between the operating state of the internal combustion engine 1 and the amount of magnetizing current to be applied to the exhaust-side electromagnetic drive mechanism 31. The ignition timing control map shows the relation between the operating state of the internal combustion engine 1 and the ignition timing of each spark plug 25. The throttle open amount control map shows the relation between the operating state of the internal combustion engine 1 and the open amount of the throttle valve 39.

RAM 403 stores output signals of each sensor, calculation results of the CPU 401, and the like. For example, the calculation results can be engine speed calculated based on an output signal of the crank position sensor 51. Various data stored in the RAM 403 are updated with the most recent data every time the crank position sensor 51 outputs a signal.

The backup RAM 404 is a non-volatile memory that stores data even after the internal combustion engine 1 has stopped operating. The backup RAM 404 stores learning values relating to various controls, information specifying a defective portion, and the like.

The CPU 401 operates according to the application programs stored in the ROM 402. The CPU 401 conducts power consumption reduction control, in addition to controls such as fuel injection control, ignition control, intake valve opening/closing control, exhaust-valve opening/closing control, throttle control, and the like.

According to the power consumption reduction control, if the power consumption of the exhaust-side electromagnetic drive mechanism 31 exceeds a predetermined value while the internal combustion engine 1 is operating in at least one of a high load region and a high revolution region, the CPU 401 changes the open timing of the exhaust valve 29 so as to reduce the amount of magnetizing current to be applied to the exhaust-side electromagnetic drive mechanism 31. Alternatively, if the amount of magnetizing current to be applied to the exhaust-side electromagnetic drive mechanism 31 per unit time exceeds the current capacity of the wire harness while the internal combustion engine 1 is operating in at least one of a high load region and a high revolution region, the CPU 401 changes the open timing of the exhaust valve 29 so as to reduce the amount of magnetizing current to be applied to the exhaust-side electromagnetic drive mechanism 31.

When the operating state of the internal combustion engine 1 is operating in the high revolution region, the number of times the intake valve 28 and exhaust valve 29 open and close per unit time is increased. This increases the amount of magnetizing current to be applied to the intake-side electromagnetic drive mechanism 30 and exhaust-side electromagnetic drive mechanism 31 per unit time. A cylinder internal pressure is generally higher when the internal combustion engine 1 is operating in the high load region than in the low load region. As described before, the cylinder has a high internal pressure during the expansion stroke due to combustion of the mixture. Accordingly, it can be considered that, when operating in the high load region, the cylinder has an extremely high internal pressure during the expansion stroke. This situation may make it difficult to supply the power required to normally control the intake and exhaust valves from the electromagnetic drive mechanisms 30, 31. As a result, the power consumption of the intake-side electromagnetic drive mechanism 30 and exhaust-side electromagnetic drive mechanism 31 is increased when the internal combustion engine 1 is operating in at least one of the high load region and the high revolution region.

However, when the intake valve 28 is opened in the intake stroke of each cylinder 21, the cylinder 21 has a negative internal pressure due to the inertia effect of the exhaust and the downward movement of the piston 22. This negative pressure acts on the intake valve 28 in the valve-opening direction, allowing the intake-side electromagnetic drive mechanism 30 to open the intake valve 28 with a relatively small amount of magnetizing current.

Accordingly, the amount of magnetizing current to be applied to the intake-side electromagnetic drive mechanism 30 per unit time does not exceed the current capacity of the wire harness. However, even if the amount of magnetizing current to be applied to the intake-side electromagnetic drive mechanism 30 is reduced, it is difficult to significantly reduce the power consumption of both the intake-side electromagnetic drive mechanism 30 and exhaust-side electromagnetic drive mechanism 31.

On the other hand, when the exhaust valve 29 is opened in the exhaust stroke of each cylinder 21, the cylinder 21 has a high internal pressure due to combustion of the mixture. Since this pressure acts on the exhaust valve 29 in the valve-closing direction, the exhaust-side electromagnetic drive mechanism 31 must open the exhaust valve 29 against this pressure. In other words, the exhaust-side electromagnetic drive mechanism 31 consumes a relatively large amount of magnetizing current in order to open the exhaust valve 29.

Therefore, it is very likely that the exhaust-side electromagnetic drive mechanism 31 consumes a large amount of power and that the amount of magnetizing current to be applied to the exhaust-side electromagnetic drive mechanism 31 per unit time reaches the current capacity of the wire harness.

Accordingly, reducing the amount of magnetizing current to be applied to the exhaust-side electromagnetic drive mechanism 31 results in significant reduction in power consumption of both the intake-side electromagnetic drive mechanism 30 and exhaust-side electromagnetic drive mechanism 31.

When the internal combustion engine 1 is operating in at least one of the high load region and the high revolution region, the open timing of the exhaust valve 29 is normally set during the expansion stroke before the bottom dead center of the exhaust stroke for the purpose of improving the exhaust and intake efficiency.

Figure 5:
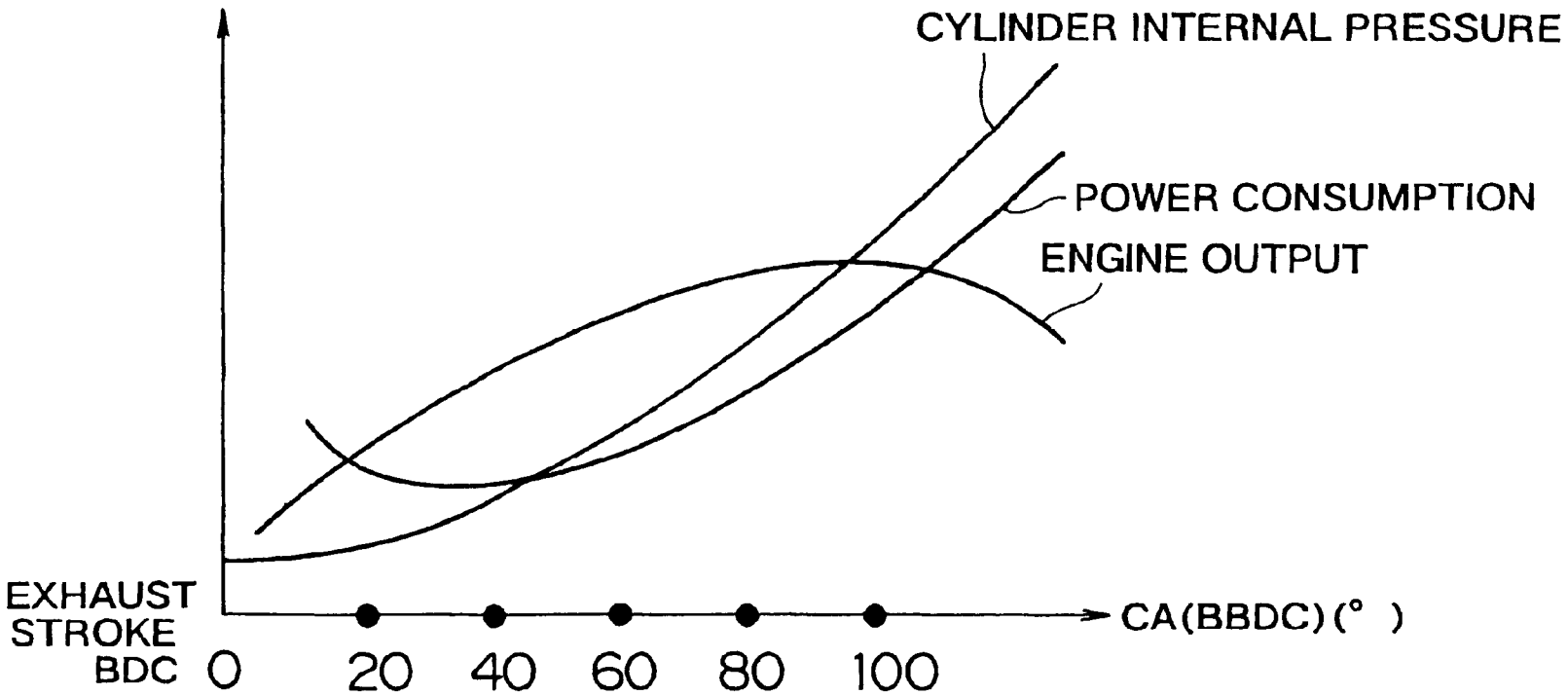
FIG. 5 is a diagram showing the relation between the open timing of an exhaust valve and the cylinder internal pressure.

For example, when operating the high revolution region where the internal combustion engine 1 generates the maximum output, the engine output reaches the highest value when the open timing of the exhaust valve 29 is set to the middle stage of the expansion stroke before the bottom dead center of the exhaust stroke, as shown in FIG. 5, i.e., near 100° CA (Crank Angle) before the bottom dead center of the exhaust stroke or 100° CA BBDC.

The reason for this outcome is that if the opening timing of the exhaust valve 29 is advanced to the initial period of the expansion stroke, the pressure generated by combustion of the mixture, i.e., combustion pressure, is not sufficiently transmitted to the piston 22. On the other hand, if the open timing of the exhaust valve 29 is retarded to the latter period of the expansion stroke, i.e., near the bottom dead center of the expansion stroke, the inertia effect of the exhaust gas cannot be sufficiently obtained and the amount of remaining gas within the cylinder 21 is increased. The result is a reduction in the charging efficiency of fresh air in the following intake stroke.

However, if the open timing of the exhaust valve 29 is set to the middle stage of the expansion stroke so as to obtain the highest engine output, the power consumption required to drive the exhaust valve 29 to open and close is increased due to the increased internal pressure of the cylinder 21, i.e., cylinder internal pressure. Note that the power consumption shown in FIG. 5 is integrated power consumption from open to close of the exhaust valve 29.

On the other hand, if the open timing of the exhaust valve 29 is set to right before the bottom dead center of the exhaust stroke, near 20° CA to 40° CA BBDC, the power consumption is reduced as compared to that in the middle stage of the expansion stroke, i.e., near 100° CA BBDC. The cylinder internal pressure near 20° CA to 40° CA BBDC is also smaller than that in the middle stage of the expansion stroke. Therefore, the power consumption from open to close of the exhaust valve 29 reaches the minimal value near 20° CA to 40° CA BBDC.

Accordingly, by retarding the open timing of the exhaust valve 29 to be in the vicinity of the bottom dead center of the exhaust stroke when the internal combustion engine 1 is operating in at least one of the high load region and the high revolution region, the power consumption of the exhaust-side electromagnetic drive mechanism 31 is significantly reduced.

In this embodiment, the CPU 401 retards the open timing of the exhaust valve 29 to be in the vicinity of the bottom dead center of the exhaust stroke if one of the two conditions described below is satisfied while the internal combustion engine 1 is operating in at least one of the high load region and the high revolution region. These two conditions include when the power consumption of the exhaust-side electromagnetic drive mechanism 31 exceeds a predetermined value and the amount of magnetizing current to be applied to the exhaust-side electromagnetic drive mechanism 31 per unit time exceeds the current capacity of the wire harness.

Figure 6:
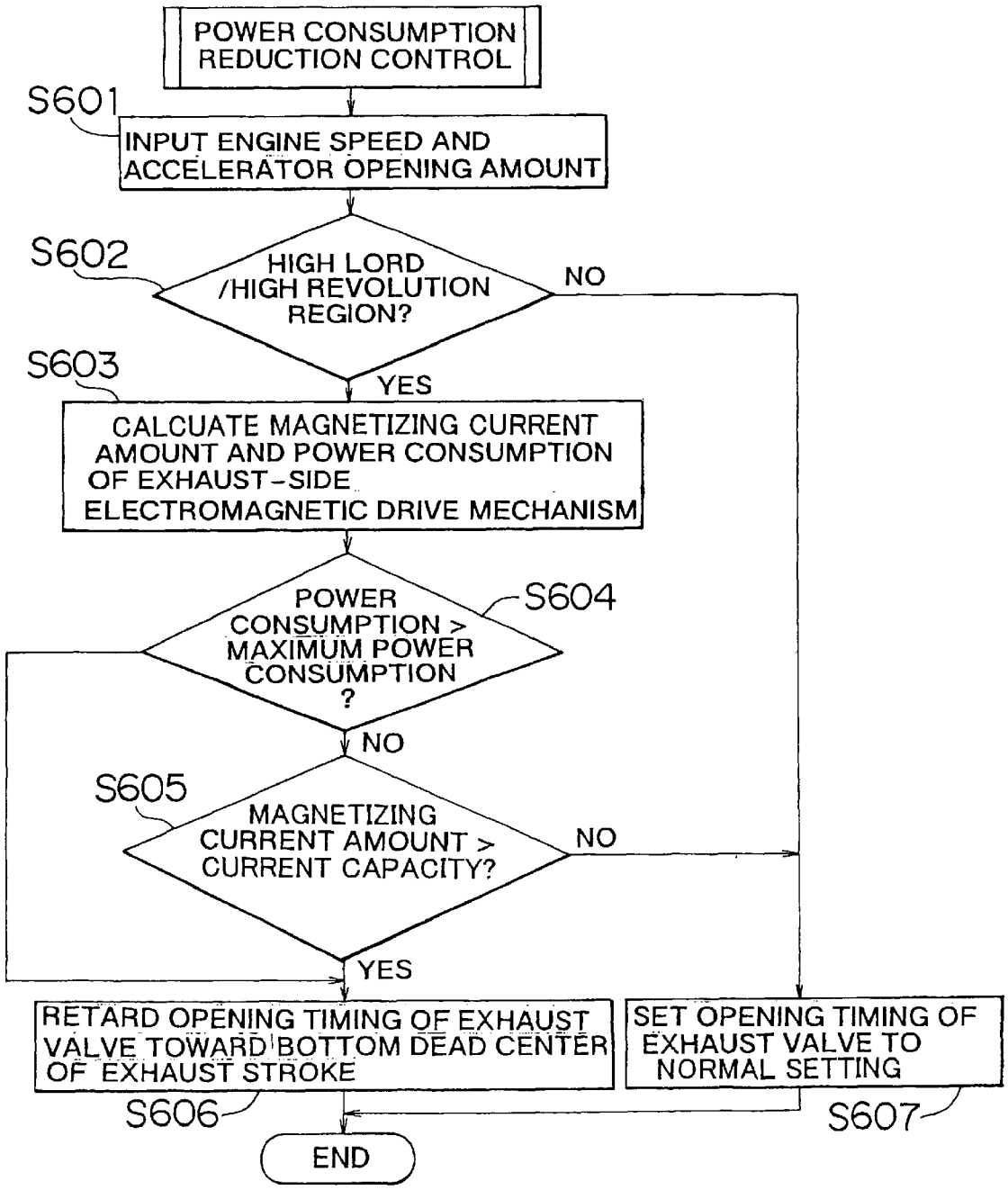
FIG. 6 is a flow chart showing a power consumption reduction control routine used in an embodiment of this invention.

Hereinafter, the power consumption reduction control according to this embodiment will be described specifically. The CPU 401 executes the power consumption reduction control routine as shown in FIG. 6. This power consumption reduction control routine is pre-stored in the ROM 402, and is repeatedly executed by the CPU 401 at predetermined time intervals, e.g., every time the crank position sensor 51 outputs a pulse signal.

In the power consumption reduction control routine, the CPU 401 first determines the engine speed and the output signal value, i.e., accelerator opening amount, of the accelerator position sensor 43 from the RAM 403 in S601.

In S602, the CPU 401 further determines, based on the engine speed and the accelerator open amount determined in S601, whether the internal combustion engine 1 is operating in at least one of the high load region and the high revolution region.

If it is determined in S602 that the internal combustion engine 1 is not operating in the high load region or the high revolution region, the CPU 401 proceeds to S607. In S607, the CPU 401 controls the exhaust-side drive circuit 31*a* so as to set the open timing of the exhaust valve 29 to a normal setting, and then the routine ends.

On the other hand, if it is determined in S602 that the internal combustion engine 1 is operating in at least one of the high load region and the high revolution region, the CPU 401 proceeds to S603. In S603, the CPU 401 calculates the power consumption of the exhaust-side electromagnetic drive mechanism 31 based on the amount of magnetizing current to be applied to the exhaust-side electromagnetic drive mechanism 31. This amount is calculated separately according to the exhaust-side magnetizing current amount control routine.

In S604, the CPU 401 determines whether the power consumption of the exhaust-side electromagnetic drive mechanism 31 calculated in S603 is larger than predetermined maximum power consumption. This maximum power consumption is obtained by subtracting the power consumption of any current consuming devices, other than the exhaust-side electromagnetic drive mechanism 31, from the generation capacity of the alternator 61. This calculation indicates the maximum possible power available for the exhaust-side electromagnetic drive mechanism 31.

In S605, the CPU 401 determines whether the amount of magnetizing current of the exhaust-side electromagnetic drive mechanism 31 calculated in S603 exceeds the current capacity of the wire harness.

If it is determined in S604 that the power consumption of the exhaust-side electromagnetic drive mechanism 31 is equal to or less than the predetermined maximum power consumption, and it is determined in S605 that the amount of magnetizing current of the exhaust-side electromagnetic drive mechanism 31 is equal to or less than the current capacity of the wire harness, the CPU 401 proceeds to S607. In S607, the CPU 401 controls the exhaust-side drive circuit 31*a* so as to set the open timing of the exhaust valve 29 to the normal setting, and then the routine ends.

However, if it is determined in S604 that the power consumption of the exhaust-side electromagnetic drive mechanism 31 is greater than the predetermined maximum power consumption, or it is determined in S605 that the amount of magnetizing current of the exhaust-side electromagnetic drive mechanism 31 exceeds the current capacity of the wire harness, the CPU 401 proceeds to S606.

In S606, the CPU 401 controls the exhaust-side drive circuit 31*a* so as to retard the open timing of the exhaust valve 29 to be in the vicinity of the bottom dead center of the exhaust stroke, and then the routine ends.

At this time, the exhaust valve open timing may be retarded either by a preset fixed amount or by a variable amount that is determined using the engine speed and the maximum power consumption as parameters.

In the case where the exhaust valve open timing is retarded by the variable amount determined using the engine speed and the maximum power consumption as parameters, a feedback control may be executed. More specifically, the retardation amount may be corrected based on the power consumption or the amount of magnetizing current after retardation of the exhaust valve open timing.

According to this embodiment, the controlling means according to the invention is realized by the CPU 401 executing the power consumption reduction control routine as such.

Thus, the internal combustion engine having an electromagnetic valve according to this embodiment makes it possible to improve reliability of the controllability to open and close the exhaust valve 29, while reducing the power consumption and the amount of magnetizing current of the exhaust-side electromagnetic drive mechanism 31, if the power consumption or the amount of magnetizing current of the exhaust-side electromagnetic drive mechanism 31 exceeds the capacity while the internal combustion engine 1 is operating in at least one of the high load region and the high revolution region.

With reduction in power consumption of the exhaust-side electromagnetic drive mechanism 31, the maximum possible power consumption of the intake-side electromagnetic drive mechanism 30 is increased. Therefore, no defective open and close operation of the intake valve 28 will occur due to the power shortage of the intake-side electromagnetic drive mechanism 30.

Moreover, the reduced power consumption of the exhaust-side electromagnetic drive mechanism 31 also allows the wire harness to have a reduced cross-sectional area. This enables reduction in space for mounting the exhaust-side electromagnetic drive mechanism 31 and the wire harness.

Moreover, if the open timing of the exhaust valve 29 is retarded while the internal combustion engine 1 is operating in at least one of the high-load region and the high revolution region, the exhaust temperature upon opening the exhaust valve is reduced, making it possible to suppress heat damages to the exhaust system components such as exhaust purifying catalyst 46.

Note that, in this embodiment, the exhaust-side electromagnetic drive mechanism 31 corresponds to the electromagnetic valve drive mechanism of the invention. In this embodiment, the controller serves as the controlling means of the invention.

In the invention, the amount, i.e., power, current, that can be supplied to the electromagnetic drive mechanism includes, for example, the value obtained by subtracting the power consumption of any current consuming device of the vehicle, other than the exhaust-side electromagnetic drive mechanism, from the generation capacity of the generator, and the current capacity of the electrical wiring, i.e., wire harness, for electrically connecting the electromagnetic valve drive mechanism to the generator. However, the amount that can be supplied to the electromagnetic drive mechanism is not limited to these values, but includes all the values dealing with the amount of power and/or current that can be supplied to the electromagnetic drive mechanism.

In the invention, an example of when the internal combustion engine is operating such that at least one of the power and/or current amount required to drive the exhaust valve to open and close exceeds the amount that can be supplied to the electromagnetic valve train is when the internal combustion engine is operating in the high revolution region and/or the high load region. The reasoning is because in the high revolution region, the number of valve opening times per unit time is increased and thus the power consumption is increased accordingly. Moreover, in the high load region, the cylinder internal pressure is generally higher than that in the low load region, whereby the power consumption required for each opening of the valve is increased.

The other embodiments of the invention will be hereinafter described.

In the aforementioned embodiment, it is determined whether the power consumption calculated based on the amount of magnetizing current to be applied to the exhaust-side electromagnetic drive mechanism is greater than the value obtained by subtracting the power consumed by any current consuming device other than the exhaust-side electromagnetic drive mechanism from the generation capacity of the generator, i.e., alternator. However, it may alternatively be determined whether the power consumption of any current consuming device, including the exhaust-side electromagnetic drive mechanism, is greater than the generation capacity of the generator. In this case, if the power consumption of the current consuming device, including the exhaust-side electromagnetic drive mechanism, is greater than the generation capacity of the generator, the open timing of the exhaust valve is changed so as to reduce the power consumption of the exhaust-side electromagnetic drive mechanism.

As a further embodiment, it is also possible to change the open timing of the exhaust valve so as to reduce the power consumption of the exhaust-side electromagnetic drive mechanism, if any one of the conditions described below is satisfied i.e., at a predetermined timing. These conditions include: when the internal combustion engine 1 is operating in the high load region; the internal combustion engine 1 is operating in the high revolution region; when the magnetizing current amount required to open the exhaust valve exceeds a predetermined reference value; when the power consumption required to open the exhaust valve exceeds a predetermined reference value; and when the power consumption of any current consuming device previously described exceeds the generation capacity of the generator. Alternatively, the open timing of the exhaust valve may be changed so as to reduce the power consumption of the exhaust-side electromagnetic drive mechanism, if any combination of the above conditions is satisfied.

In the above embodiment, the open timing of the exhaust valve is retarded to be in the vicinity of the bottom dead center of the exhaust stroke. However, the open timing of the exhaust valve may alternatively be retarded just toward the bottom dead center of the exhaust stroke, rather than being retarded to be in the vicinity of the bottom dead center of the exhaust stroke. Note that it is preferable that the open timing of the exhaust valve is not retarded to after the bottom dead center of the exhaust stroke. The reason for this preference is that after the bottom dead center of the exhaust valve, the piston moves upward within the cylinder. As a result, the burned gas within the cylinder is compressed, thereby increasing the pressure acting on the exhaust valve in the valve-closing direction.

It is only necessary that the power consumption of the exhaust-side electromagnetic drive mechanism, after changing the open timing, is less than before. Therefore, for example, the open timing of the exhaust valve may be changed toward the minimal power consumption, i.e., toward reduced power consumption, or may be changed toward a lower cylinder internal pressure than that of the current open timing.

In the illustrated embodiment, the controllers are implemented with general purpose processors. It will be appreciated by those skilled in the art that the controllers can be implemented using a single special purpose integrated circuit (e.g., ASIC) having a main or central processor section for overall, system-level control, and separate sections dedicated to performing various different specific computations, functions and other processes under control of the central processor section. The controllers can be a plurality of separate dedicated or programmable integrated or other electronic circuits or devices (e.g., hardwired electronic or logic circuits such as discrete element circuits, or programmable logic devices such as PLDs, PLAs, PALs or the like). The controllers can be suitably programmed for use with a general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controllers. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. An internal combustion engine, comprising:

an electromagnetic valve drive mechanism that controls an exhaust valve of the internal combustion engine to open and close by using an electromagnetic force generated by an application of magnetizing current; and controlling means for changing an open timing of the exhaust valve at a predetermined time so that a cylinder internal pressure at the changed open timing is lower than the cylinder internal pressure at an open timing of normal operation.

2. A method for controlling an internal combustion engine, comprising the steps of:

determining whether predetermined conditions are met; and changing an open timing of an exhaust valve so as to reduce a power consumption of an electromagnetic valve drive mechanism that opens the exhaust valve, when the predetermined conditions are met, wherein the open timing of the exhaust valve is retarded to be in the vicinity of a bottom dead center of an exhaust stroke when changing the open timing of the exhaust valve.

3. The method according to claim 2, wherein the open timing of the exhaust valve is retarded to the point before the bottom dead center of the exhaust stroke.

4. A method for controlling an internal combustion engine, comprising the steps of:

determining whether predetermined conditions are met; and changing an open timing of an exhaust valve so as to reduce a power consumption of an electromagnetic valve drive mechanism that opens the exhaust valve, when the predetermined conditions are met, wherein the open timing of the exhaust valve is changed toward a lower cylinder internal pressure than that of a current open timing when changing the open timing of the exhaust valve.

5. An internal combustion engine, comprising:

an electromagnetic valve drive mechanism that controls an exhaust valve of the internal combustion engine to open and close by using an electromagnetic force generated by an application of magnetizing current; and a controller that controls the electromagnetic valve drive mechanism, wherein the controller changes an open timing of the exhaust valve so as to reduce a power consumption of the electromagnetic valve drive mechanism when the internal combustion engine is operating in a state where at least one of a power and a current amount required to control the exhaust valve to open and close exceeds an amount that can be supplied to the electromagnetic valve drive mechanism.

6. An internal combustion engine, comprising:

an electromagnetic valve drive mechanism that controls an exhaust valve of the internal combustion engine to open and close by using an electromagnetic force generated by applicating of magnetizing current; and a controller that controls the electromagnetic valve drive mechanism, wherein the controller changes, under a predetermined condition, an open timing of the exhaust valve so as to reduce a power consumption of the electromagnetic valve drive mechanism and so that a cylinder internal pressure at the changed open timing is lower than the cylinder internal pressure at an open timing of normal operation.

7. The internal combustion engine according to claim 1, wherein the controller changes the open timing of the exhaust valve so as to reduce the power consumption when the internal combustion engine is operating in at least one of a high revolution region and a high load region.

8. An internal combustion engine, comprising:

an electromagnetic valve drive mechanism that controls an exhaust valve of the internal combustion engine to open and close by using an electromagnetic force generated by applicating of magnetizing current; and a controller that controls the electromagnetic valve drive mechanism, wherein the controller changes, under a predetermined condition, an open timing of the exhaust valve so as to reduce a power consumption of the electromagnetic valve drive mechanism, wherein the controller changes the open timing of the exhaust valve so as to reduce the power consumption when at least one of the following conditions is satisfied:

the power consumption required to open the exhaust valve exceeds a first reference value;

the power consumption of a current consuming device of a vehicle exceeds a second reference value; and the magnetizing current amount required to open the exhaust valve exceeds a third reference value.

9. The internal combustion engine according to claim 8, wherein the first reference value is obtained by subtracting the power consumption of the current consuming device of the vehicle, other than an exhaust-side electromagnetic drive mechanism, from a generation capacity of a generator.

10. The internal combustion engine according to claim 8, wherein the second reference value is a generation capacity of a generator.

11. The internal combustion engine according to claim 8, wherein the third reference value is a current capacity of electrical wiring that electrically connects the electromagnetic valve drive mechanism to a generator.

12. An internal combustion engine, comprising:

an electromagnetic valve drive mechanism that controls an exhaust valve of the internal combustion engine to open and close by using an electromagnetic force generated by applicating of magnetizing current; and a controller that controls the electromagnetic valve drive mechanism, wherein the controller changes, under a predetermined condition, an open timing of the exhaust valve so as to reduce a power consumption of the electromagnetic valve drive mechanism, wherein the controller changes the open timing of the exhaust valve so as to reduce the power consumption when the internal combustion engine is operating in at least one of a high revolution region and a high load region, and when at least one of the following conditions is satisfied the power consumption required to open the exhaust valve exceeds a first reference value;

the power consumption of a current consuming device of a vehicle exceeds a second reference value; and a magnetizing current amount required to open the exhaust valve exceeds a third reference value.

13. An internal combustion engine, comprising:

an electromagnetic valve drive mechanism that controls an exhaust valve of the internal combustion engine to open and close by using an electromagnetic force generated by applicating of magnetizing current; and a controller that controls the electromagnetic valve drive mechanism, wherein the controller changes, under a predetermined condition, an open timing of the exhaust valve so as to reduce a power consumption of the electromagnetic valve drive mechanism, wherein the controller monitors whether the power consumption required to open the exhaust valve exceeds a first reference value and whether the power consumption of a current consuming device of a vehicle exceeds a second reference value, and whether a magnetizing current amount required to open the exhaust valve exceeds a third reference value; and the controller changes the open timing of the exhaust valve so as to reduce the power consumption of the electromagnetic valve drive mechanism when at least one of the following conditions is satisfied:

the power consumption required to open the exhaust valve exceeds the first reference value;

the power consumption of the current consuming device of the vehicle exceeds the second reference value; and the magnetizing current amount required to open the exhaust valve exceeds the third reference value.

14. An internal combustion engine, comprising:

an electromagnetic valve drive mechanism that controls an exhaust valve of the internal combustion engine to open and close by using an electromagnetic force generated by applicating of magnetizing current; and a controller that controls the electromagnetic valve drive mechanism, wherein the controller changes, under a predetermined condition, an open timing of the exhaust valve so as to reduce a power consumption of the electromagnetic valve drive mechanism, wherein the controller changes, under a predetermined condition, the open timing of the exhaust valve toward a lower cylinder internal pressure than that of a current open timing.

15. An internal combustion engine, comprising:

an electromagnetic valve drive mechanism that controls an exhaust valve of the internal combustion engine to open and close by using an electromagnetic force generated by applicating of magnetizing current; and a controller that controls the electromagnetic valve drive mechanism, wherein the controller changes, under a predetermined condition, an open timing of the exhaust valve so as to reduce a power consumption of the electromagnetic valve drive mechanism, wherein the controller retards, under a predetermined condition, the open timing of the exhaust valve to be in the vicinity of a bottom dead center of an exhaust stroke.

16. The internal combustion engine according to claim 15, wherein the controller retards the open timing of the exhaust valve to a timing before the bottom dead center of the exhaust stroke.

17. A method for controlling an internal combustion engine, comprising the steps of:

determining whether predetermined conditions are met; and changing an open timing of an exhaust valve so as to reduce a power consumption of an electromagnetic valve drive mechanism that opens the exhaust valve, when the predetermined conditions are met and so that a cylinder internal pressure at the changed open timing is lower than the cylinder internal pressure at an open timing of normal operation, when the predetermined conditions are met.

18. The method according to claim 17, wherein the predetermined timing is determined when the internal combustion engine is operating in at least one of a high revolution region and a high load region.

19. A method for controlling an internal combustion engine, comprising the steps of:

determining whether predetermined conditions are met; and changing an open timing of an exhaust valve so as to reduce a power consumption of an electromagnetic valve drive mechanism that opens the exhaust valve, when the predetermined conditions are met, wherein the predetermined timing is determined when at least one of the following conditions is satisfied:

the power consumption required to open the exhaust valve exceeds a first reference value;

the power consumption of a current consuming device of a vehicle exceeds a second reference value; and a magnetizing current amount required to open the exhaust valve exceeds a third reference value.

20. The method according to claim 19, wherein the first reference value is obtained by subtracting the power consumption of the current consuming device other than an exhaust-side electromagnetic drive mechanism from a generation capacity of a generator.

21. The method according to claim 19, wherein the second reference value is a generation capacity of a generator.

22. The method according to claim 19, wherein the third reference value is a current capacity of electrical wiring that electrically connects the electromagnetic valve drive mechanism to a generator.

23. A method for controlling an internal combustion engine, comprising the steps of:

determining whether predetermined conditions are met; and changing an open timing of an exhaust valve so as to reduce a power consumption of an electromagnetic valve drive mechanism that opens the exhaust valve, when the predetermined conditions are met, wherein the predetermined conditions is determined when the internal combustion engine is operating in at least one of a high revolution region and a high load region, and when at least one of the following conditions is satisfied the magnetizing current amount required to open the exhaust valve exceeds a first reference value;

the power consumption required to open the exhaust valve exceeds a second reference value; and the power consumption of a current consuming device of a vehicle exceeds a third reference value.

24. A method for controlling an internal combustion engine, comprising the steps of:

determining whether predetermined conditions are met; and changing an open timing of an exhaust valve so as to reduce a power consumption of an electromagnetic valve drive mechanism that opens the exhaust valve, when the predetermined conditions are met, wherein the step of determining the predetermined timing comprises the steps of determining at least one of when the power consumption required to open the exhaust valve exceeds a first reference value and when the power consumption of a current consuming device exceeds a second reference value; and determining when a magnetizing current amount required to open the exhaust valve exceeds a third reference value, wherein the open timing of the exhaust valve is changed when it is determined that at least one of the following conditions is satisfied the power consumption required to open the exhaust valve exceeds the first reference value;

the power consumption of the current consuming device of the vehicle exceeds the second reference value; and the magnetizing current amount required to open the exhaust valve exceeds the third reference value.

* * * * *